US007540215B2

(12) United States Patent
Hoberman et al.

(10) Patent No.: US 7,540,215 B2
(45) **Date of Patent: *Jun. 2, 2009**

(54) SYNCHRONIZED RING LINKAGES

(75) Inventors: Charles Hoberman, 472 Greenwich St., New York, NY (US) 10013; Matthew Davis, Newtown, PA (US)

(73) Assignee: Charles Hoberman, New York, NY (US)

( * ) Notice: Subject to any disclaimer, the term of this patent is extended or adjusted under 35 U.S.C. 154(b) by 584 days.

This patent is subject to a terminal disclaimer.

(21) Appl. No.: 10/962,986

(22) Filed: Oct. 12, 2004

(65) Prior Publication Data

US 2005/0097832 A1 May 12, 2005

Related U.S. Application Data

(60) Provisional application No. 60/512,633, filed on Oct. 20, 2003.

(51) Int. Cl.
*B25J 17/00* (2006.01)

(52) U.S. Cl. ..... 74/490.05; 428/12; 446/487

(58) Field of Classification Search ..... 74/490.01, 74/490.05; 428/12; 446/487
See application file for complete search history.

(56) References Cited

U.S. PATENT DOCUMENTS 4,780,344 A 10/1988 Hoberman
4,816,310 A * 3/1989 Truyens ..... 428/12
4,942,700 A 7/1990 Hoberman
4,981,732 A 1/1991 Hoberman
5,024,031 A 6/1991 Hoberman
5,234,727 A 8/1993 Hoberman
6,077,027 A * 6/2000 Kawamura et al. ..... 414/744.5
6,082,056 A 7/2000 Hoberman
6,190,231 B1 2/2001 Hoberman
6,219,974 B1 4/2001 Hoberman
6,739,098 B2 5/2004 Hoberman
6,834,465 B2 12/2004 Hoberman
2002/0083675 A1 7/2002 Hoberman
2002/0112413 A1 8/2002 Hoberman
2003/0037491 A1 2/2003 Hoberman
2003/0097801 A1 5/2003 Hoberman
2004/0134157 A1 7/2004 Hoberman
2006/0159868 A1 * 7/2006 Hoberman et al. ..... 428/12

* cited by examiner

*Primary Examiner*—David M Fenstermacher
(74) *Attorney, Agent, or Firm*—Gottlieb, Rackman & Reisman

(57) ABSTRACT

A ring linkage is hereby disclosed that is comprised of at least six links, each link having at least two pivots located proximate to their ends, said links being arranged in a loop whereby each link is pivotally attached via its end pivots to two neighboring links.

The motion of the linkage is synchronized by a multiplicity of mechanical elements that serve to synchronize the relative rotation of the links in the assembly such that when a given link rotates by an angle, every second link rotates by the same angle. These synchronizing elements may be either gears, cables or belts, thus the relative angle between the every second link in the ring linkage (as defined by lines passing through their respective end pivots) remains constant and unchanging even as the position of the linkage is changed.

12 Claims, 11 Drawing Sheets

SYNCHRONIZED RING LINKAGES

This application is based on and claims priority of provisional application Ser. No. 60/512,633, filed Oct. 20, 2003

U.S. Pat. No. 5,024,031 hereby incorporated by reference as if fully disclosed herein teaches methods for constructing transformable truss-structures in a variety of shapes. The teachings therein have been used to build structures for diverse applications including architectural uses, public exhibits and unique folding toys.

One basic embodiment disclosed in U.S. Pat. No. 5,024,031 are loop-assemblies comprised of scissor-pairs which are in turn comprised of angulated strut elements. Such loop-assembles are foldable in the sense that they expand and contract in a synchronized fashion when a relative motion is imposed between any two links.

BACKGROUND OF THE INVENTION

SUMMARY OF THE INVENTION

In accordance with the present invention, a new way to create loop assemblies comprised of links pivotally joined end to end such that the motion of the assembly is provided. The synchronization may be accomplished in a variety of methods such as gears, belts or pulleys. All methods have in common the linking of every second link in the loop assembly such that the relative rotation of every second link is synchronized.

One key benefit of the invention is a reduction in the number of individual elements as compared with those structures disclosed in U.S. Pat. No. 5,024,031. Rather than all links being "doubled" in the form of scissor-pairs, a single loop of links suffices. The addition of gears or pulleys represents only minor additional material.

The invention has a second useful feature as well. For structures disclosed in '031, they move between a contracted state and expanded state. As the structure expands, its members rotate approximately ninety degrees. When the structure is fully expanded, the members are prevented from rotating further because the hub elements contact each other.

According to the current invention, structures are disclosed such that its members rotate approximately one hundred and eighty degrees. Thus, the structure starts in a contracted state, where its members are in a radial configuration, to an expanded state where its members form an extended loop, and then it can be continuously folded again so that it reaches a second, unique contracted state.

This unusual ability to "flip" between two unique folded states allow for structures to be built that display a pleasing visual transformation.

A third useful feature of the current invention is that it provides a mechanism whereby a circular ring that has flight on characteristics can transform into a boomerang.

It is thus an object of the invention to provide an improved ring linkage system.

Another object of the invention is to provide a linkage system whose motion is synchronized.

Yet a further object of the invention is to provide an improved linkage having a plurality of links in geared contact with one another.

Other objects and advantages of the invention will, in part, be obvious and will, in part, be apparent from the following description.

BRIEF DESCRIPTION OF THE DRAWINGS

For a fuller understanding of the invention, reference is made to the following description, taken in connection with the accompanying drawings in which.

DETAILED DESCRIPTION OF THE PREFERRED EMBODIMENTS

Figure 1:
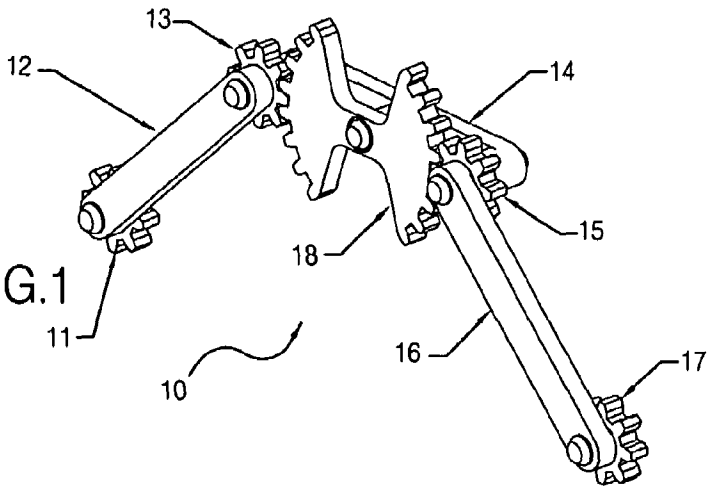
FIG. 1 is a perspective view of three links pivotally connected to each other and made in accordance with the invention.

FIG. 1 shows a perspective view of mechanical assembly 10 consisting of three links 12, 14 and 16 which are pivotally connected to each other end-to-end. Link 12 has two ends 11 and 13 each of which has a geared profile. Similarly the ends of link 16 has two ends 15 and 17 ends each of which have a geared profile.

Gear 18 is pivotally connected to link 14. Gear end 13 engages with gear 18; likewise gear end 15 engages with gear 18.

Figure 2:
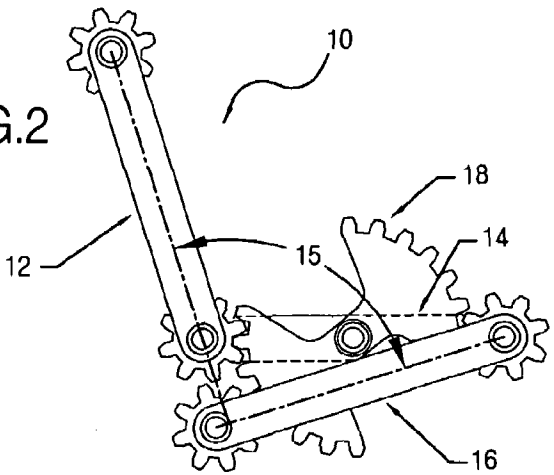
FIG. 2 is a plan view of the three links of FIG. 1 in a partially folded condition.

FIG. 2 shows a plan view of assembly 10. The two dashed lines shown passing through the end pivots of links 12 and 16 form an angle 15 between them.

Figure 3:
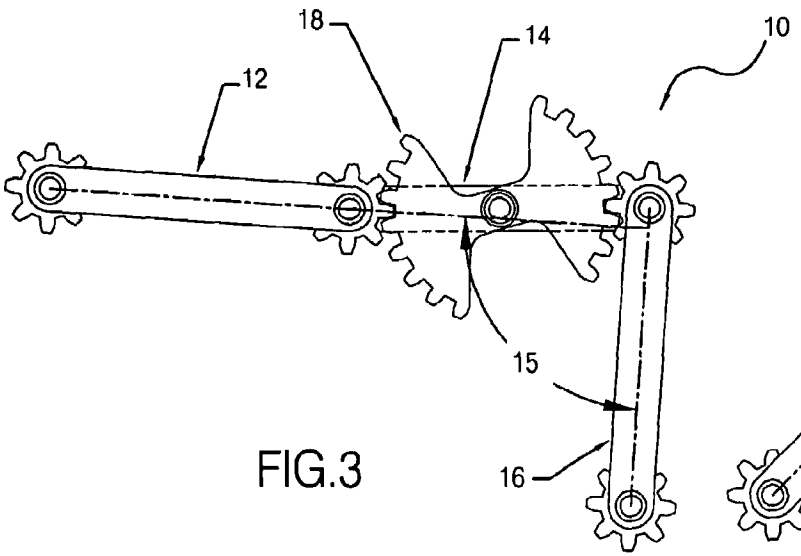
FIG. 3 is a plan view of the three links of FIG. 1 in a partially extended condition.

FIG. 3 shows assembly 10 in a different position, links 12 and 16 having been rotated relative to link 14. Links 12 and 16 form an angle 15 between them, said angle being unchanged from the angle shown in FIG. 2. The reason that this angle remains unchanged is because gear 18 synchronizes the relative motion of links 12 and 16.

Figure 4:
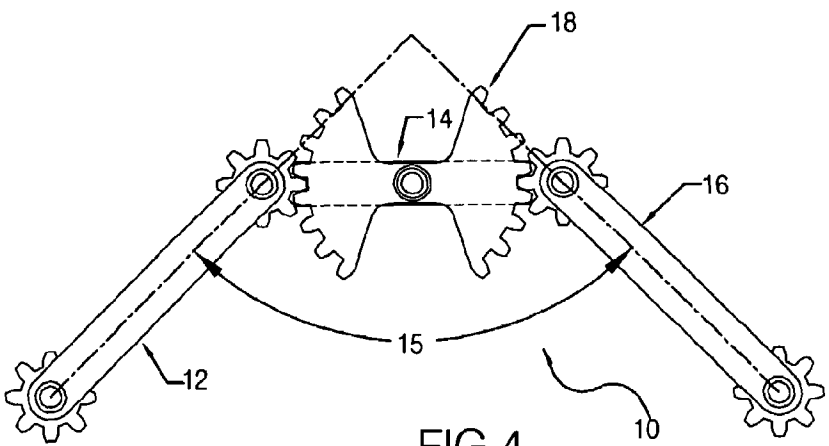
FIG. 4 is a plan view of the three links of FIG. 1 in a third angled condition.

FIG. 4 shows assembly 10 in a third position. The relative angle between links 12 and 16 remains unchanged.

Figure 5:
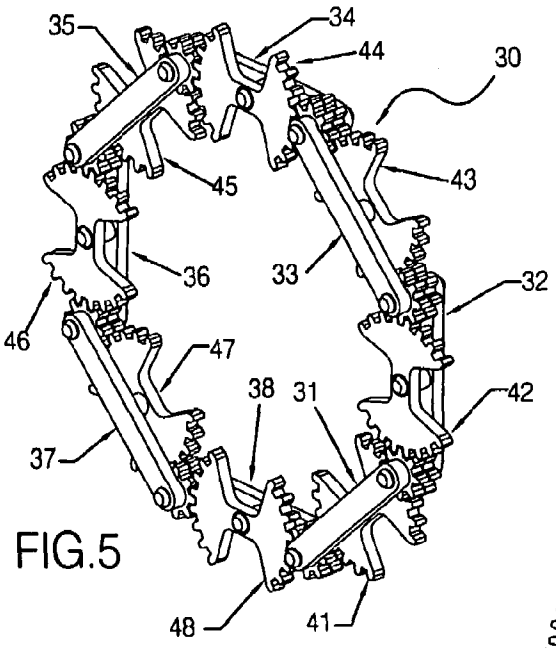
FIG. 5 is a perspective view of a first embodiment of the linkage assembly of the invention.

FIG. 5 shows a perspective view of linkage 30 which is comprised of eight links 31,32,33,34,35,36,37 and 38 which are pivotally connected end to end. Each link terminates with two gear ends. Gear 41 is pivotally attached to link 31. Likewise gears 42,43,44,45,46,47 and 48 are respectively pivotally attached to links 32,33,34,35,36,37 and 38.

The gear ends of link 31 engage with gears 48 and 42. Likewise the gear ends of all the links engage with the gears which are pivotally attached to their neighboring links.

Figure 6:
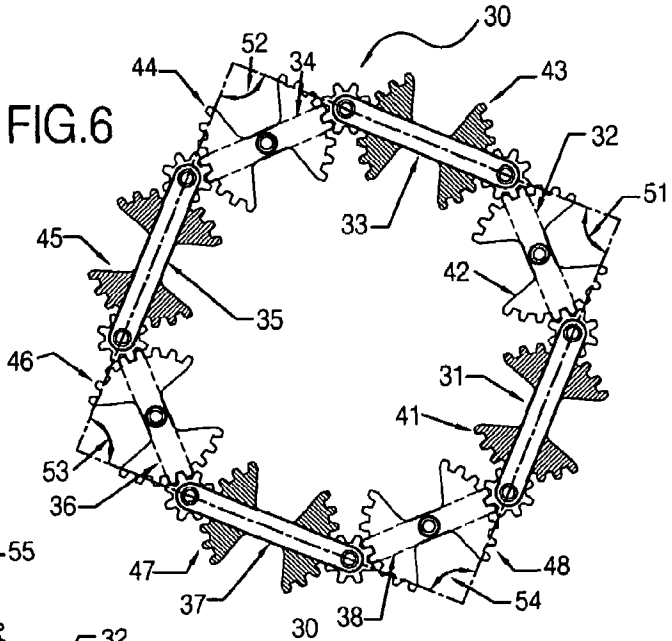
FIG. 6 is a plan view of the linkage of FIG. 5.

FIG. 6 shows linkage 30 in plan view. Links 31 and 33 are pivotally connected to link 32 and their respective gear ends are engaged with gear 42. The dashed lines passing through the end pivots of links 31 and 33 form an angle 51 between them. Similarly the dashed lines passing through link pairs 33-35, 35-37 and 37-31 form angles 52, 53 and 54 respectively.

Figure 7:
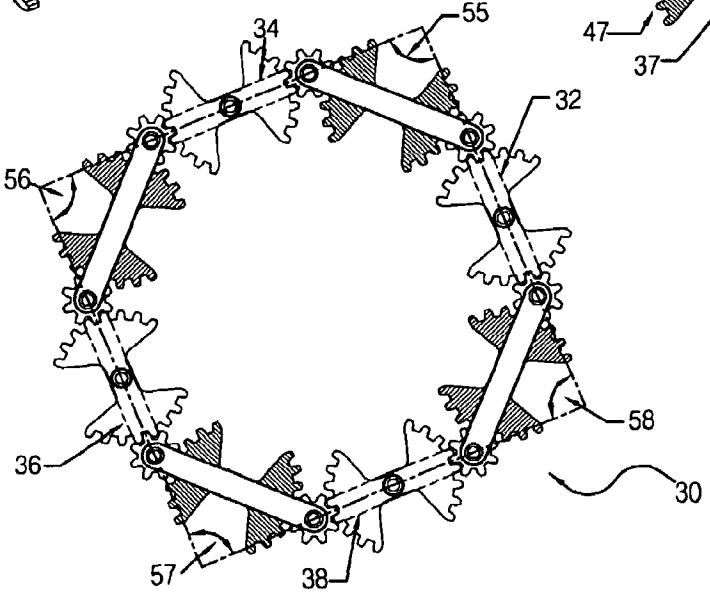
FIG. 7 is also a plan view of the linkage assembly of FIG. 5 and similar to FIG. 6.

FIG. 7 shows linkage 30 in the same view as FIG. 6, with angles 55,56,57,58 being formed by the dashed lines passing through link pairs 32-34, 34-36, 36-38 and 38-32 respectively.

Figure 8:
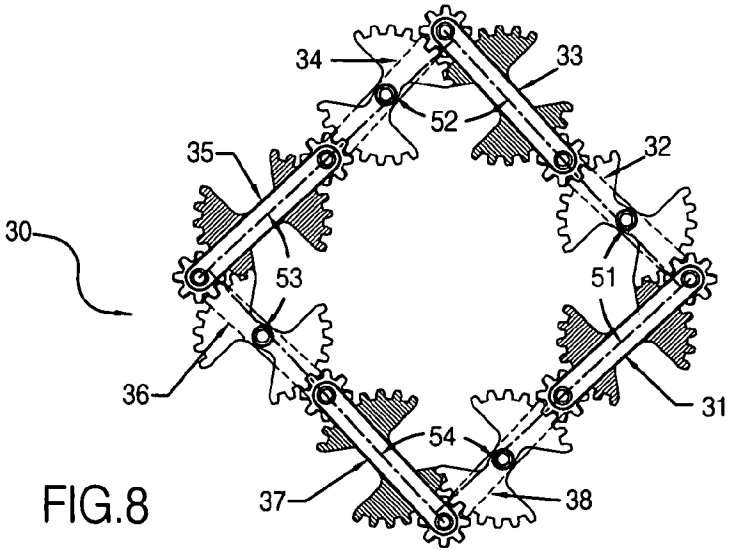
FIG. 8 is a plan view of the linkage assembly of FIG. 5 shown in a different position.

FIG. 8 shows linkage 30 in a different position. The angle 51 formed by the dashed lines passing through links 31 and 33 is unchanged from FIG. 6. Likewise, the similarly formed angles 52,53 and 54 are unchanged from those formed in FIG. 6.

Figure 9:
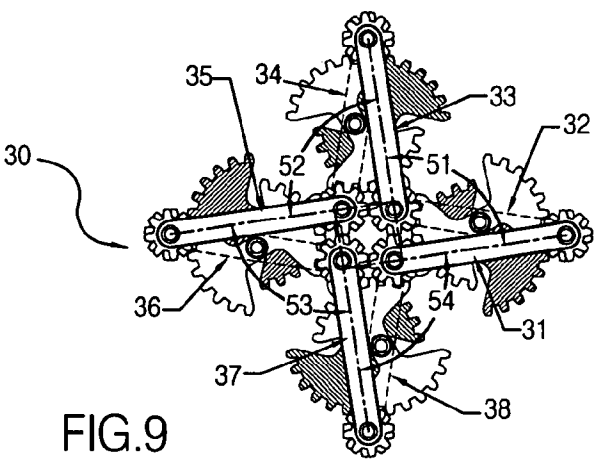
FIG. 9 is a plan view of the linkage assembly of FIG. 5 in a folded condition.

FIG. 9 shows linkage 30 in a folded position. The four angles 51,52,53 and 54 respectively formed between link pairs 31-33, 33-35, 35-37 and 37-31 are unchanged from those formed in FIGS. 6 and 7.

Figure 10:
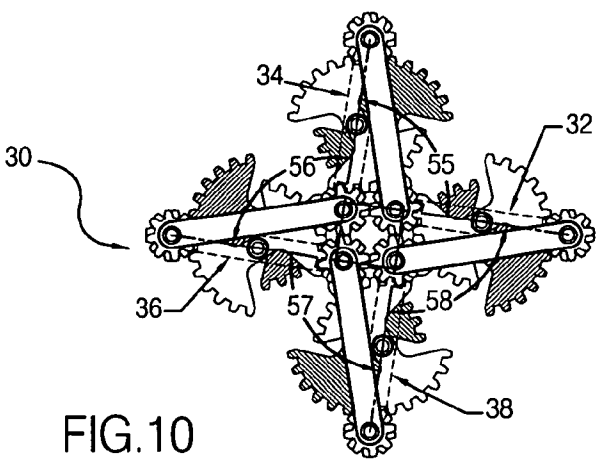
FIG. 10 is a plan view of the linkage assembly of FIG. 5 and similar to FIG. 9.

FIG. 10 shows linkage 30 in the same view as FIG. 9. The four angles 51, 52, 53 and 54 respectively formed between link pairs 32-34, 34-36, 36-38 and 38-32 are unchanged from those formed in FIGS. 6 and 7.

Thus linkage 30 demonstrates a key feature of the invention: the relative angle between two links that are each connected to a common link between them, and that are synchronized by a gear that is connected to said common link, will form a constant and unchanging angle for any given position of the linkage.

Figures 11, 12, 13, 14:
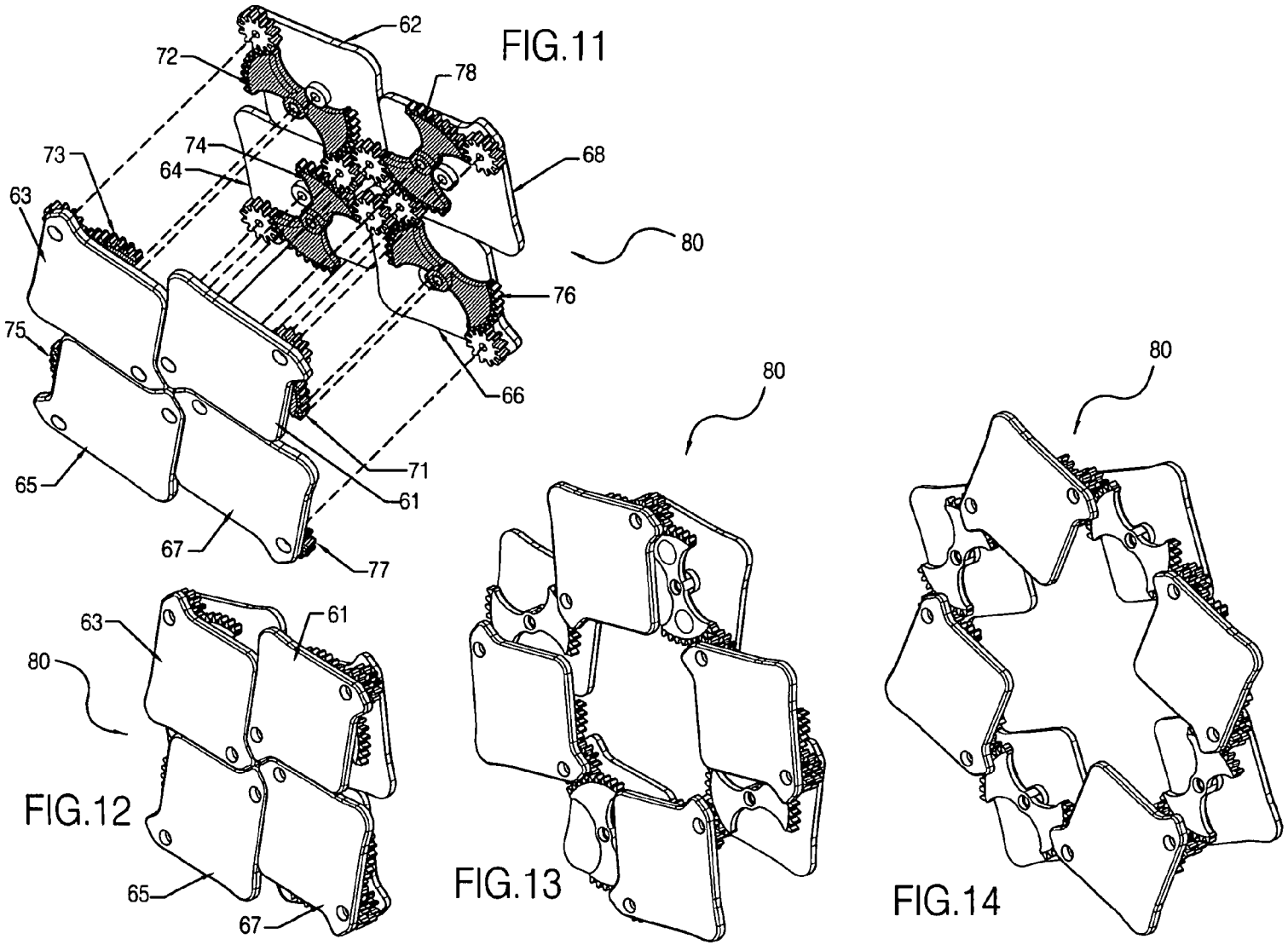
FIG. 11 is an exploded perspective view of a second embodiment of the linkage assembly of the invention.
FIG. 12 is a perspective view of the linkage assembly of FIG. 1 in a closed position.
FIG. 13 is a perspective view of the assembly of FIG. 11 in a partially open condition.
FIG. 14 is a perspective view of the linkage assembly of FIG. 11 in a fully open condition.

In FIG. 11, an assembly 80 is shown in exploded view. Assembly 80 is comprised of eight links having a polygonal profile, one layer comprised of links 61,63 65 and 67; a second layer comprised of links 62,64,66 and 68. Additionally eight gears 71,72,73,74,75,76,77 and 78 are pivotally connected respectively to the eight links.

FIG. 12 shows assembly 80 in a closed position whereby links 61, 63, 65 and 67 form a continuous surface. FIG. 13 shows assembly 80 in a partially open position and FIG. 14 shows 80 in its fully opened position.

Figure 17:
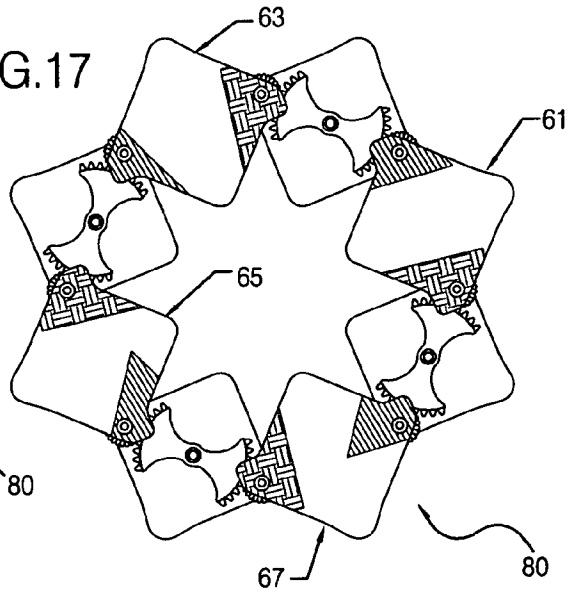
FIG. 17 is a plan view of the linkage assembly of FIG. 11 in a fully open condition.
Figure 16:
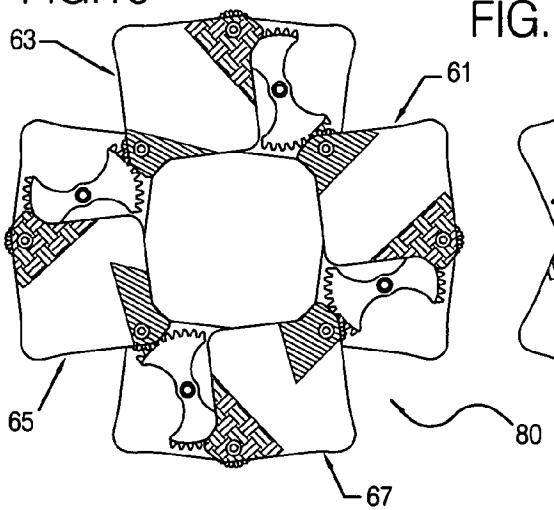
FIG. 16 is a plan view of the linkage assembly of FIG. 11 in a partially open condition.
Figure 15:
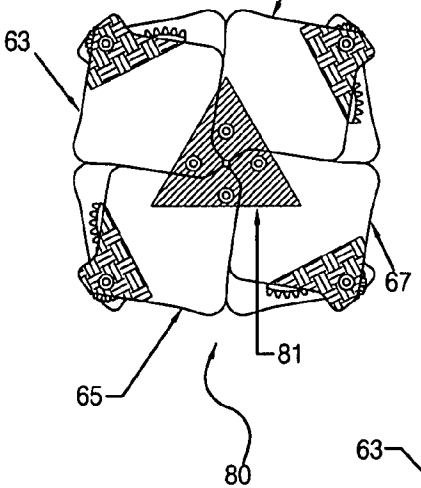
FIG. 15 is a plan view of the linkage assembly of FIG. 11.

FIG. 15 shows a assembly 80 in plan view. An image of a triangle 81 has been printed on links 61, 63, 65 and 67. FIG. 16 and FIG. 17 show assembly 80 in a partially opened and fully opened position respectively.

Figure 19:
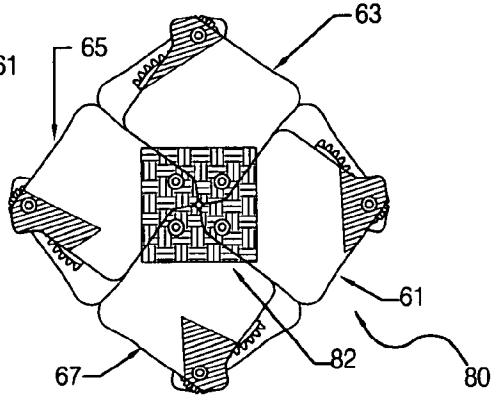
FIG. 19 is a plan view of the linkage assembly of FIG. 11 in a second closed condition.
Figure 18:
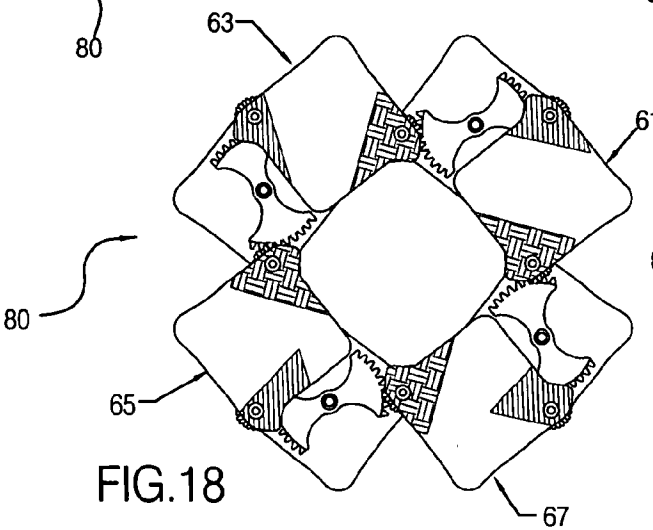
FIG. 18 is a plan view of the linkage assembly of FIG. 11 in a second partially open condition.

FIG. 18 shows assembly 80 in a second partially opened position whereby the links have been rotated past their fully opened position. FIG. 19 shows assembly 80 in its second closed position. A second image of a square 82 has been printed on links 61, 63, 65 and 67. Thus, assembly 80 is shown to have the capability to "flip" between two separate images.

Figure 20:
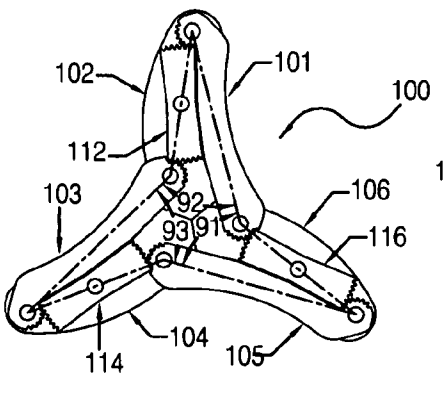
FIG. 20 is a plan view of a third embodiment of a linkage assembly in accordance with the invention.

FIG. 20 shows an assembly 100 comprised of six links 101, 102,103,104,105 and 106 which are pivotally connected end to end. Three gears 112, 114 and 116 are pivotally attached to links 102,104 and 106 respectively. Angles 91,92 and 93 are shown formed between link-pairs 105-101, 101-103 and 103-105 respectively.

Figure 21:
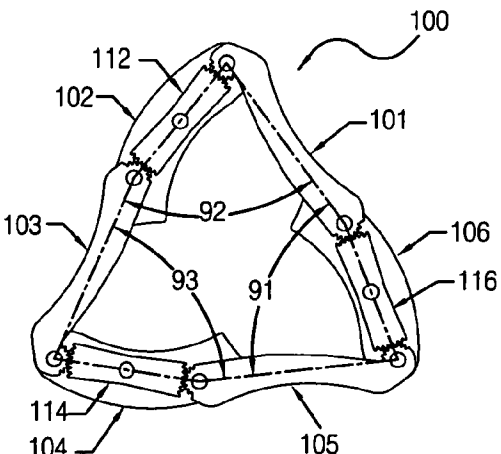
FIG. 21 is a plan view of the linkage assembly of FIG. 20 in a partially open condition.

FIG. 21 shows assembly 100 in a partially opened position. The angles between link pairs 105-101, 101-103 and 103-105 are respectively 91,92 and 93 being unchanged from FIG. 20.

Figure 22:
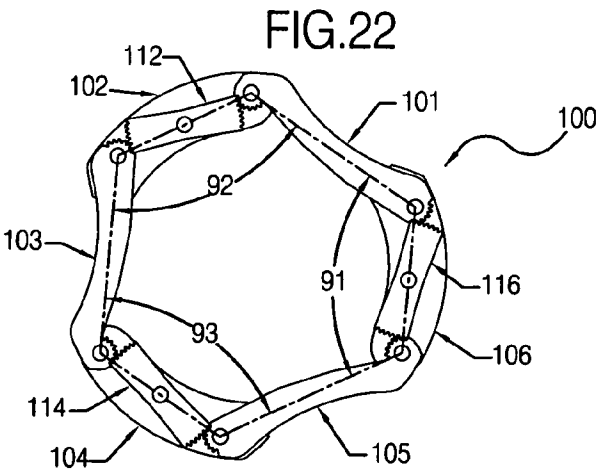
FIG. 22 is a plan view of the linkage assembly of FIG. 20 in a fully open condition.

FIG. 22 shows assembly 100 in a fully opened position. The angles between link pairs 105-101, 101-103 and 103-105 are respectively 91,92 and 93 being unchanged from FIGS. 20 and 21.

Figure 24:
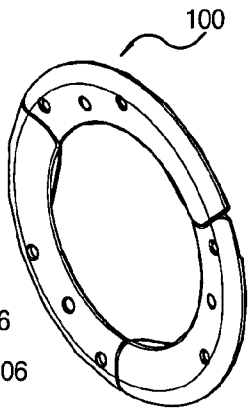
FIG. 24 is a perspective view showing the covering panels of FIG. 23 forming a ring.
Figure 23:
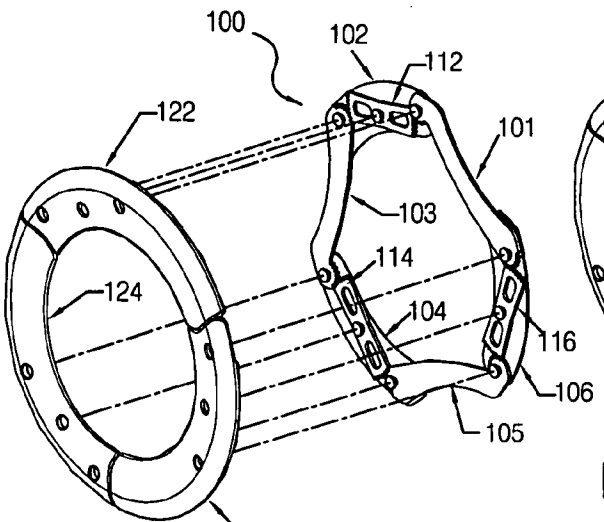
FIG. 23 is an exploded perspective view of covering panels suitable for attaching to the linkage assembly of FIG. 20.

FIG. 23 shows assembly 100 in exploded view with three covering panels 122, 124 and 126 shown. FIG. 24 shows these covering panels attached to links 102, 104 and 106 respectively such that a ring is formed when 100 is in its fully opened position. Said ring has certain flying characteristics for straight sustained flight when thrown in a spinning motion.

Figure 26:
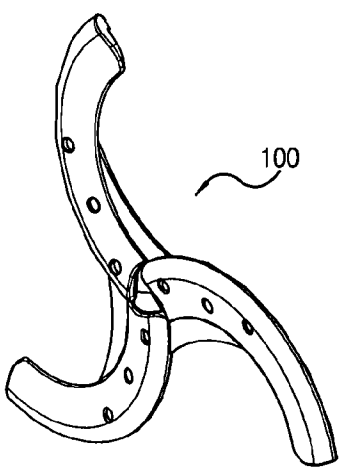
FIG. 26 shows the covering panels of FIG. 23 in a fully closed condition.
Figure 25:
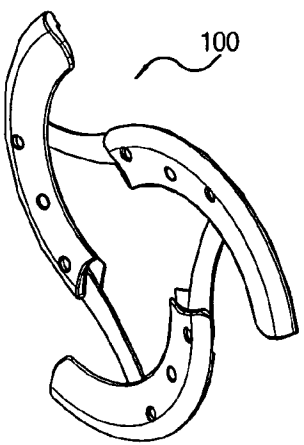
FIG. 25 is a perspective view showing the covering panels of FIG. 23 in a partially open condition.

FIG. 25 shows assembly 100 with its attached covering panels shown in a partially opened position. FIG. 26 shows assembly 100 in its fully closed position such that it forms the profile of a three pronged shape. Said shape has certain flying characteristics similar to a boomerang when thrown with a spin such that it flies in a loop returning to the thrower.

Figure 27:
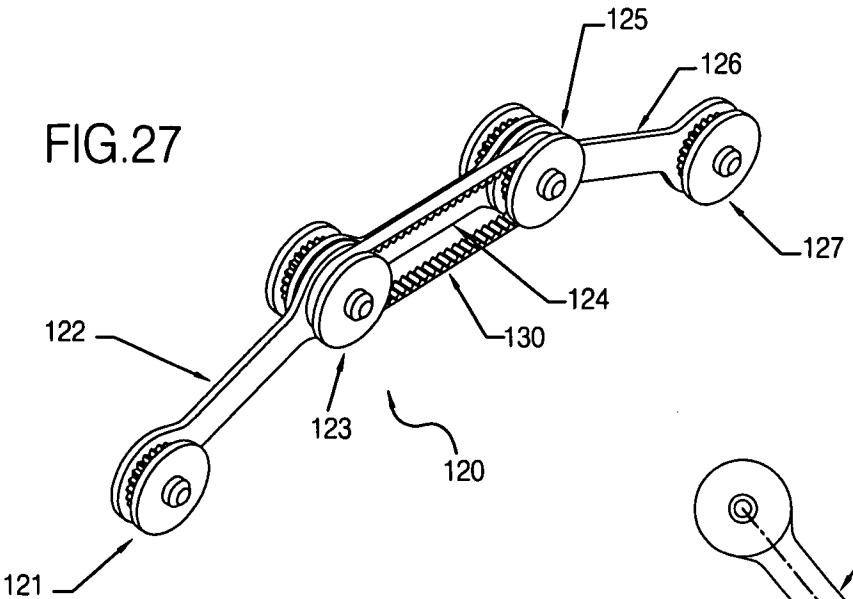
FIG. 27 is a perspective view of another linkage assembly made in accordance with the invention.

FIG. 27 shows a perspective view of mechanical assembly 120 consisting of three links 122, 124 and 126 which are pivotally connected to each other end-to-end. Link 122 has two ends 121 and 123 each of which have an attached pulley. Similarly, the ends of link 126 has two ends 125 and 127 ends each of which have an attached pulley.

Figure 28:
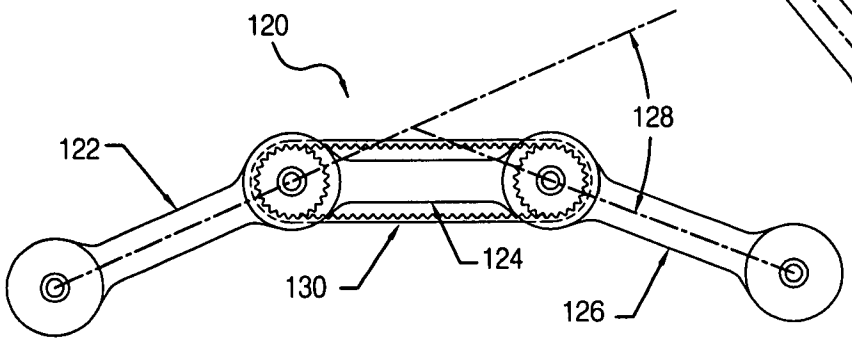
FIG. 28 is a plan view of the linkage assembly of FIG. 27 in an extended condition.

Belt 130 engages pulley ends 123 and 125. FIG. 28 shows a plan view of assembly 120. The two dashed lines shown passing through the end pivots of links 122 and 126 form an angle 128 between them.

Figure 29:
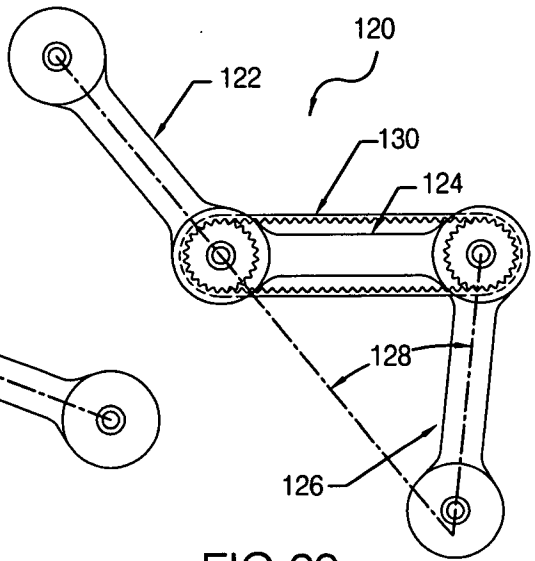
FIG. 29 is a plan view of the linkage assembly of FIG. 27 in a partially angled condition.

FIG. 29 shows assembly 120 in a different position, links 122 and 126 having been rotated relative to link 124. Links 122 and 126 form an angle 128 between them, said angle being unchanged from the angle shown in FIG. 28. The reason that this angle remains unchanged is because belt 130 synchronizes the relative motion of links 122 and 126.

Figure 30:
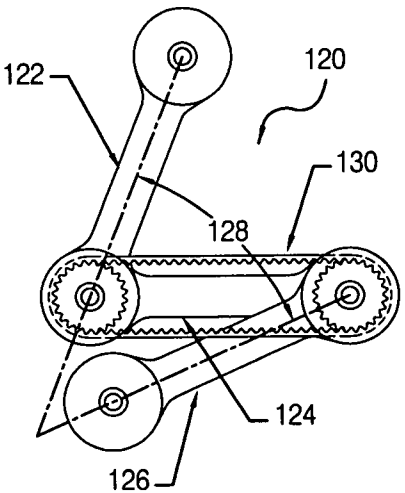
FIG. 30 is a plan view of the linkage assembly of FIG. 27 in a folded condition.

FIG. 30 shows assembly 120 in a third position. The relative angle 128 between links 122 and 126 remains unchanged.

Figure 31:
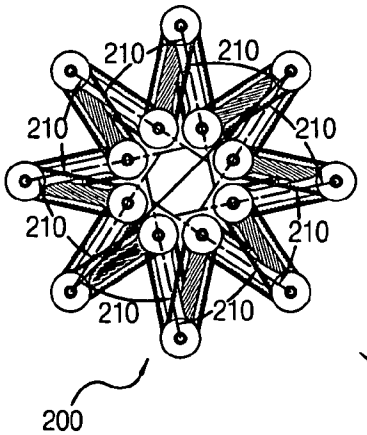
FIG. 31 is a plan view of still another embodiment of the linkage assembly made in accordance with the invention.
Figure 32:
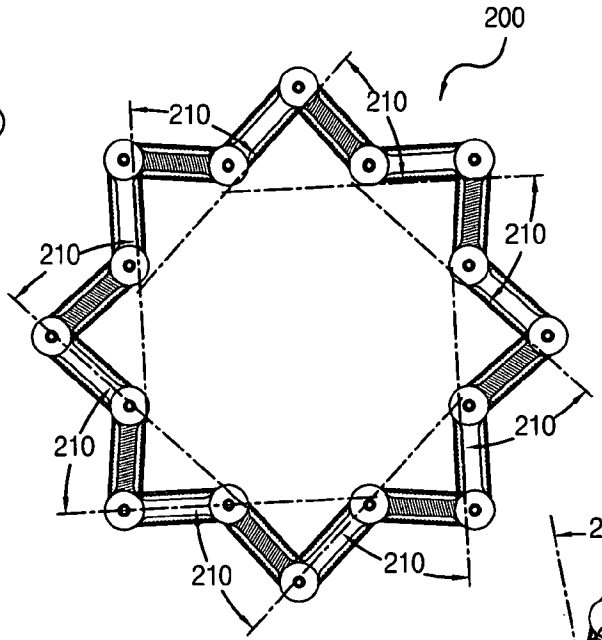
FIG. 32 is a plan view of the linkage assembly of FIG. 31 in a partially open condition.

FIG. 31 shows a loop assembly 200 comprised of sixteen links, each having two pulley ends, every other link being connected via a belt such that a constant angle 210 is formed between every other link. FIG. 32 shows assembly 200 in a different position where the angle 210 between every second link is unchanged.

Figure 33:
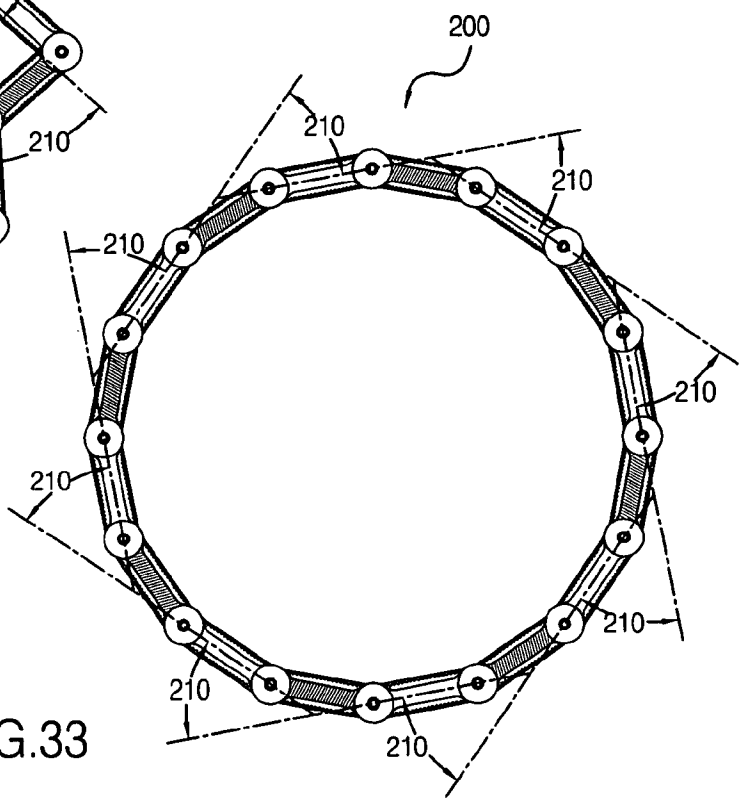
FIG. 33 is a plan view of the linkage assembly of FIG. 31 in a fully open condition.

FIG. 33 shows assembly 200 in its fully opened position, the angle 210 between every second link remaining unchanged.

Figure 34:
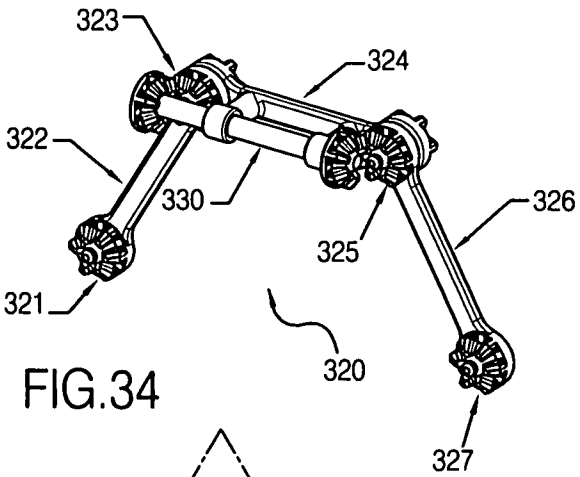
FIG. 34 is a perspective view of yet a further embodiment of the linkage assembly of the invention.

FIG. 34 shows a perspective view of mechanical linkage assembly 320 consisting of three links 322, 324 and 326 which are pivotally connected to each other end-to-end. Link 322 has two ends 321 and 323 each of which have an attached bevel gear. Similarly the ends of link 326 has two ends 325 and 327 ends each of which have a geared an attached bevel gear.

Figure 35:
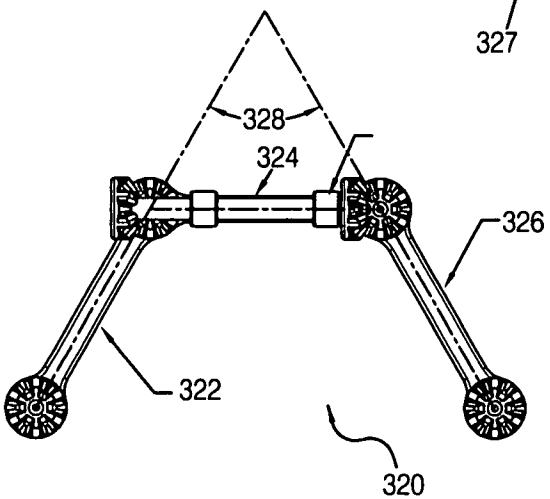
FIG. 35 is a plan view of the linkage assembly of FIG. 34.

Gear assembly 330 comprised of two bevel gears fixed to a common shaft is pivotally connected to link 324 and engages bevel gear ends 323 and 325. FIG. 35 shows a plan view of assembly 320. The two dashed lines shown passing through the end pivots of links 322 and 326 form an angle 328 between them.

Figure 36:
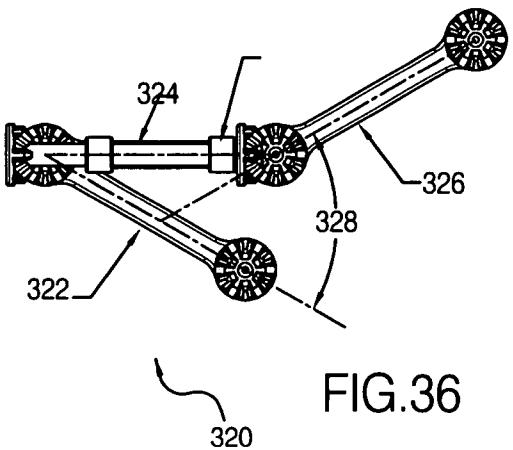
FIG. 36 is a plan view of the linkage assembly of FIG. 34 in a partially folded condition.

FIG. 36 shows assembly 320 in a different position, links 322 and 326 having been rotated relative to link 324. Links 322 and 326 form an angle 328 between them, said angle being unchanged from the angle shown in FIG. 35. The reason that this angle remains unchanged is because gear assembly 330 synchronizes the relative motion of links 322 and 326.

Figure 37:
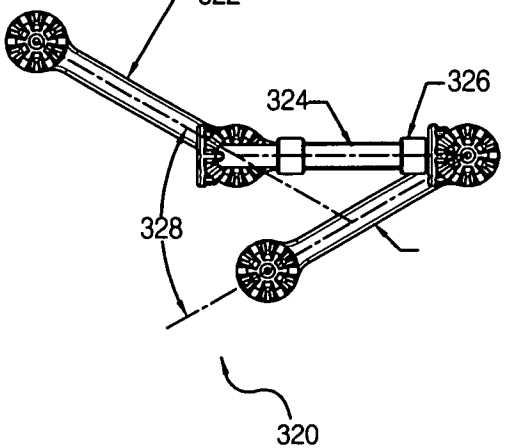
FIG. 37 is a plan view of the linkage assembly of FIG. 34 in an alternative folded condition.

FIG. 37 shows assembly 320 in a third position. The relative angle 328 between links 322 and 326 remains unchanged.

Figure 38:
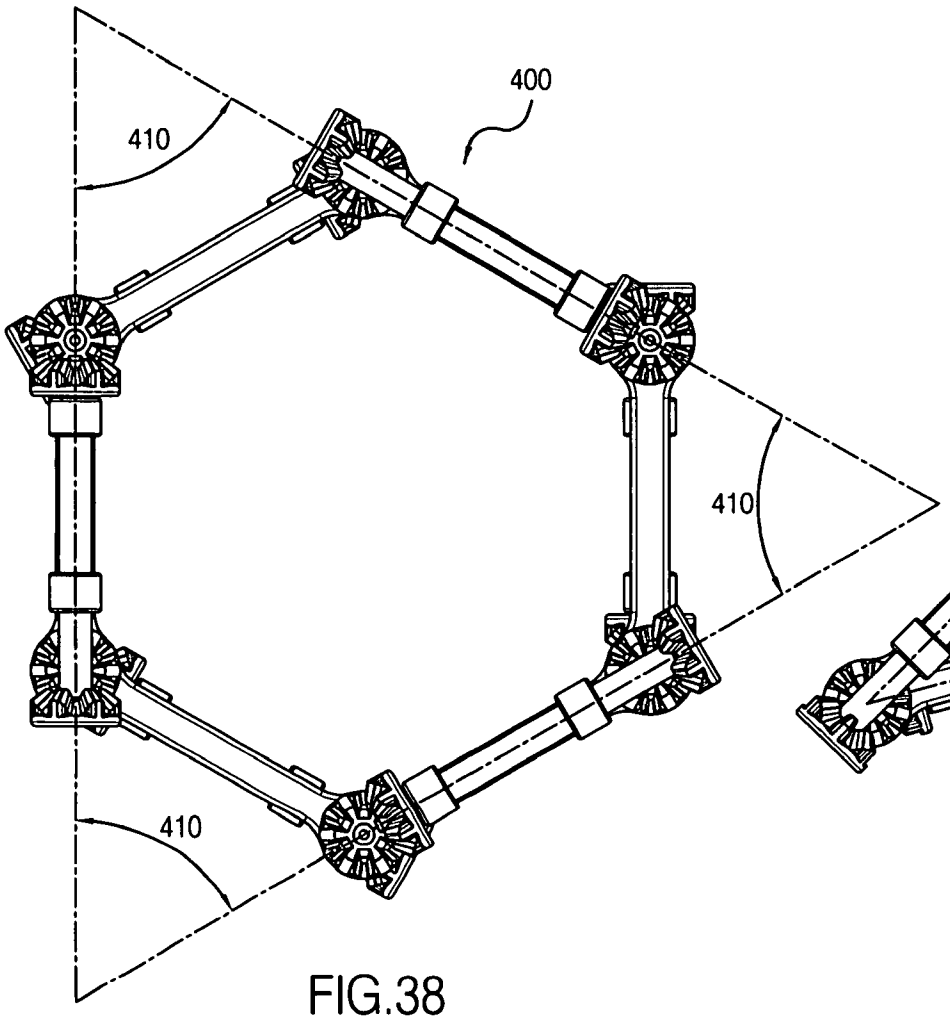
FIG. 38 is a plan view of yet another embodiment of a linkage assembly of the invention.

FIG. 38 shows a linkage or loop assembly 400 comprised of six links, each having two bevel gear ends, every other link being connected via a bevel gear assembly such that a constant angle 410 is formed between every other link.

Figure 39:
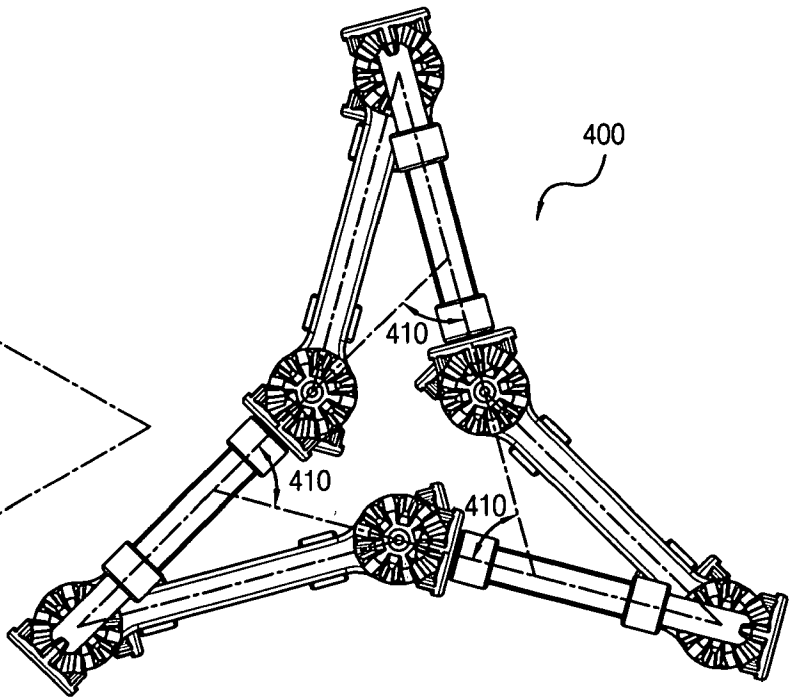
FIG. 39 is a plan view of a linkage assembly of FIG. 38 in a partially closed condition.

FIG. 39 shows assembly 200 in a different position where the angle 410 between every second link is unchanged.

Figure 40:
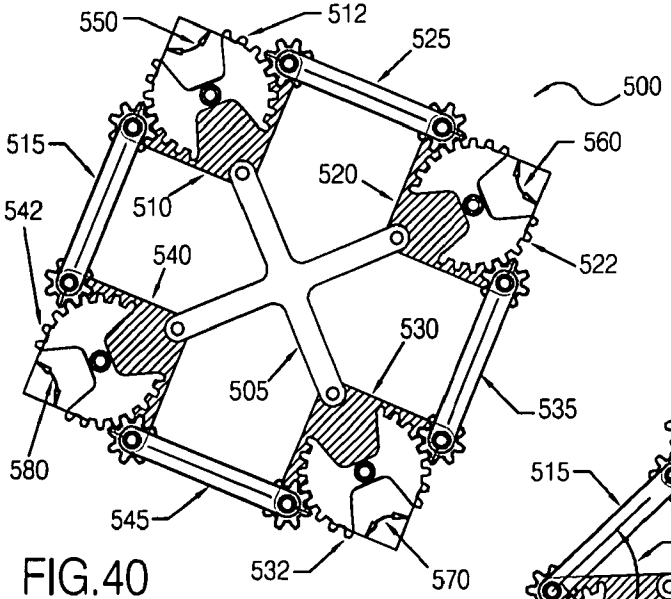
FIG. 40 is a top plan view of a further embodiment of a linkage assembly of the invention.

FIG. 40 shows an assembly 500 which is comprised of four links 515, 525, 535 and 545 each having two gear ends, four links 510, 520, 530 and 540 having a triangular profile and three pivots each. Four gears 512, 522, 532 and 542 are pivotally attached to links 510, 520, 530 and 540 respectively. Assembly 500 further includes a central link 505 which is pivotally connected to the third pivot each of links 510, 520, 530 and 540. Central link 505 serves to assist in the synchronization of assembly 500.

An angle 550 is formed between links 515 and 525. Similarly, angles 560, 570 and 580 are formed between link-pairs 525, 535; 535, 545; and 545, 515 respectively.

Figure 41:
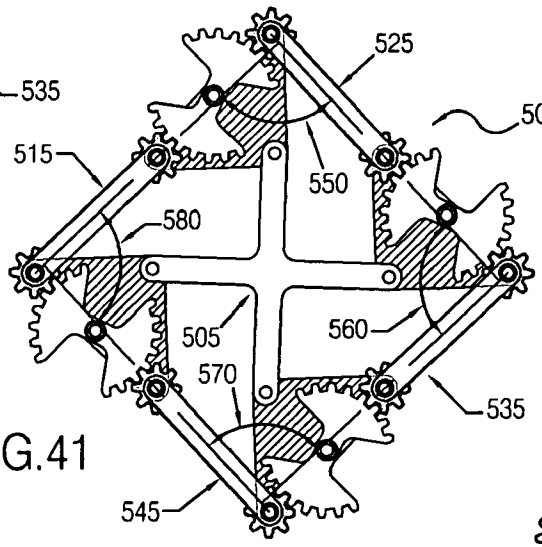
FIG. 41 is a top plan view showing the linkage assembly of FIG. 40 in a different position.

FIG. 41 shows assembly 500 in a different position. The angle 550 formed between links 515 and 525 is unchanged from FIG. 40. Similarly, angles 560, 570 and 580 are formed between link-pairs 525, 535; 535, 545; and 545, 515, and are unchanged from FIG. 40.

Figure 42:
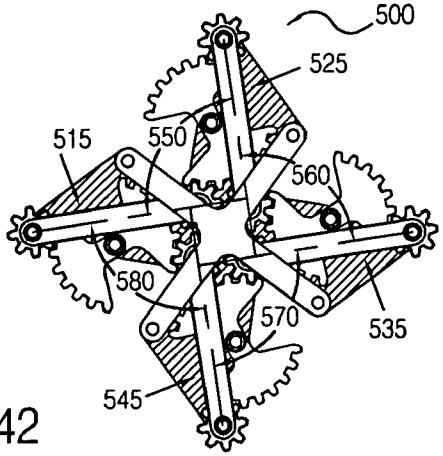
FIG. 42 is a top plan view showing the linkage assembly of FIG. 40 in yet another position.

FIG. 42 shows assembly 500 in another position. Angles 550, 560, 570 and 580 are formed between link-pairs 515, 525; 525, 535, 535, 545; and 545,515, and are unchanged from FIGS. 40 and 41.

It will thus be seen that the objects set forth above, among those made apparent from the proceeding description, are efficiently attained, and, in since certain changes may be made in the construction of the inventive structure without departing from the spirit and scope of the invention, it is intended that all matter contained in the above description and shown in the accompanying drawings shall be interpreted as illustrative and not in a limiting sense.

It is also to be understood that the following claims are intended to cover all of the general and specific features of the invention described herein and all statements of the scope of the invention which, as a matter of language, might be said to fall there between.

The invention claimed is

1. A ring linkage comprising at least six links, each link having a first end and a second a opposite end, each link including a pivot located proximate to each said end, said links being arranged in a loop configuration such that each link is pivotally attached at its pivots to said first ends of two adjacent non-joined links;

wherein at least two of said links each includes means connected between said first ends of its two adjacent non-joined links for synchronizing the relative rotation of said non-joined links such that when one adjacent link rotates in one rotational direction by a given angle the other link rotates in the same rotational direction and by the same angle.

2. The linkage of claim 1, wherein said synchronizing means is selected from the group consisting of gears, cables and belts.

3. The linkage of claim 1, wherein each link has two geared ends.

4. The linkage of claim 3, wherein each geared end of each said link engages a geared end of an adjacent link.

5. The linkage of claim 1, wherein each link has an attached pully at either end.

6. The linkage of claim 5, wherein said every other link in the ring linkage is defined by a belt for engaging the attached pully at the end of each adjacent link.

7. The linkage of claim 1, wherein each link has an attached beveled gear at either end.

8. The linkage of claim 1 wherein said every other link in the ring linkage is connected to its adjacent links by a bevel gear assembly.

9. The linkage of claim 1 wherein at least some of said links includes a covering panel.

10. The linkage of claim 1, wherein said two adjacent links of said each link define a link pair having an angle therebetween that remains constant when said linkage is manipulated between a first closed condition and a second open condition.

11. The linkage of claim 10, wherein said linkage has a profile of at least a three prong shape when in a fully closed condition.

12. The linkage of claim 1, wherein at least one covering panel covers all of said links such that a ring is formed when said linkage is in a fully open condition.

* * * * *